US005879228A

United States Patent [19]

Sun

[11] Patent Number: 5,879,228

[45] Date of Patent: Mar. 9, 1999

[54] PNEUMATIC GRINDING/POLISHING MACHINE

[76] Inventor: Yung-yung Sun, No. 21-6, Shang-Tien Lane, Hsin-Hsing Road, Ta-Li, Taichung Hsien, Taiwan

[21] Appl. No.: 970,451

[22] Filed: Nov. 14, 1997

[51] Int. Cl.[6] ..... B24B 23/04

[52] U.S. Cl. ..... 451/357; 451/353; 451/359

[58] Field of Search ..... 451/344, 353, 451/354, 350, 351, 352, 356, 357, 358, 359

[56] References Cited

U.S. PATENT DOCUMENTS

| | | | |
|---|---|---|---|
| 4,467,565 | 8/1984 | Wallace et al. | 451/357 |
| 4,660,329 | 4/1987 | Hutchins | 451/357 |
| 4,671,019 | 6/1987 | Hutchins | 451/357 |
| 4,854,085 | 8/1989 | Huber | 451/357 |
| 5,319,888 | 6/1994 | Huber et al. | 451/357 |
| 5,445,558 | 8/1995 | Hutchins | 451/357 X |
| 5,453,040 | 9/1995 | Schaal et al. | 451/357 X |
| 5,595,530 | 1/1997 | Heidelberger | 451/356 |

*Primary Examiner*—Timothy V. Eley
*Attorney, Agent, or Firm*—Rosenberg, Klein & Bilker

[57] ABSTRACT

A pneumatic grinding/polishing machine is disclosed. It includes a fixed upper casing, a lower casing, an annular wall, an upper sealing member, a lower sealing member, a rotor, multiple vanes, a central shaft assembly and a grinding tray assembly. An inlet port of the annular wall is disposed above an outlet port and the inlet port and the outlet port are isolated from each other by a middle stopper ring. The upper sealing member has an upper stopper ring and an upper cover body. The lower sealing member has a lower stopper ring and a lower cover body. A dustproof sheath is disposed around the second bearing for preventing the splashing dusts from contacting with the second bearing. Therefore, this invention is easy to assemble and manufacture, no leakage, long using life.

2 Claims, 8 Drawing Sheets

PNEUMATIC GRINDING/POLISHING MACHINE

BACKGROUND OF THE INVENTION

The present invention relates to a pneumatic grinding/polishing machine in which a middle stopper ring serves to effectively isolate the upper inlet port from the lower outlet port with an excellent leakproof effect. Also, a dustproof sheath is used to prevents the splashing dusts from entering the second bearing so as to prolong the using life of the grinding/polishing machine.

FIGS. 1 to 3 show an existing pneumatic grinding/polishing machine which includes a fixed upper casing 11, a lower casing 12, an annular wall 13, an upper and a lower sealing members 14, 15, a rotor 21, multiple vanes 22, a central shaft assembly 23 and a grinding tray assembly 24.

The upper casing 11 is formed with an air inlet 111 connected to an external high pressure air source, an air outlet 112 communicated with atmosphere, a central chamber 113, an inlet passage 114 and an outlet passage 115. The lower casing 12 is secured to the bottom edge of the upper casing 11. The annular wall 13 is formed with an inlet port 131, an outlet port 132 and a rotor receptacle 133. The upper sealing member 14 is disposed with an upper partitioning ring 141 and an upper cover body 142. The lower sealing member 15 is disposed with a lower partitioning ring 151 and a lower cover body 152.

The rotor 21 has multiple equally spaced vane slots 211 for receiving the vanes 22. The central shaft assembly 23 includes a central shaft 231 engaged with the rotor 21, an eccentric block 232 positioned in the lower casing and an eccentric recessed seat having an opening facing downward (not shown). The grinding tray assembly 24 includes a grinding tray shaft 241 and a grinding tray 242 for grinding the surface of a work piece. The rotor 21 is rotatably disposed on the upper and lower sealing members 14, 15 via two bearings, that is, indirectly rotatably disposed on the upper casing 11. Similarly, the grinding tray assembly 24 is rotatably disposed in the recessed seat of the central shaft assembly 23 via another bearing.

After high pressure air is guided into the air inlet 111, the air goes into the inlet port 131 for pushing the vanes 22 so as to rotate the rotor 21. The air is finally exhausted from the air outlet 112 through the outlet port 132. The rotor 21 will drive the central shaft assembly 23 to rotate for driving the eccentric grinding tray 242 to irregularly rotate so as to grind the surface of the work piece.

The conventional pneumatic grinding/polishing machine has some shortcomings as follows:

1. The manufacturing and assembling procedures are troublesome. The conventional pneumatic grinding/polishing machine includes specifically shaped upper and lower partitioning rings 141 and 151. Especially, the upper partitioning ring 141 has two downward extending vertical sections 141A each of which has a toothed portion 141B at its free end. Similarly, the lower partitioning ring 151 has two upward extending lower vertical sections 151A each of which has a corresponding toothed portion 151B at its free end. Therefore, after assembled, the engaged upper and lower vertical sections 141A, 151A can just separate the inlet port 131 and outlet port 132 from each other. It is difficult and time-consuming to manufacture and assemble such elements with vertical sections and toothed portions. Also, the manufacturing cost for such elements is relatively high.

2. The conventional pneumatic grinding/polishing machine is subject to leakage of air. After engaged, a gap will still exist between the toothed portions 141B and 151B. After a period of use, due to high speed rotation of the rotor 21 and the eccentrically irregular rotation of the grinding tray 242, the gap between the toothed portions 141B, 151B will be enlarged. This will lead to leakage of air.
3. Short using life. During grinding, the grinding tray 242 is eccentrically irregularly rotated at high speed. This will make the lower casing 12 fill with irregularly splashed dust. This dust is restricted within the lower casing 12 and tend to be left in the bearing, especially in the second bearing 26 as shown in FIG. 7. Moreover, the bearing itself contains multiple ball members and lubricant so that the dust is apt to attach thereto to damage the bearing or harden the lubricant. This will disable the rotor 21 from smoothly rotating.

SUMMARY OF THE INVENTION

In order to obviate the above problems, it is a primary object of the present invention to provide a pneumatic grinding/polishing machine which has simple structure and can be easily manufactured and assembled.

It is a further object of the present invention to provide the above grinding/polishing machine in which a middle stopper ring is used to effectively isolate the inlet port from the outlet port so as to achieve an excellent leakproof effect.

It is still a further object of the present invention to provide the above grinding/polishing machine in which a dustproof sheath is used to prevent the splashing dust from entering the second bearing so as to prolong the using life of the grinding/polishing machine.

The present invention can be best understood through the following description and accompanying drawings, wherein:

DETAILED DESCRIPTION OF THE PREFERRED EMBODIMENT

Figure 1:
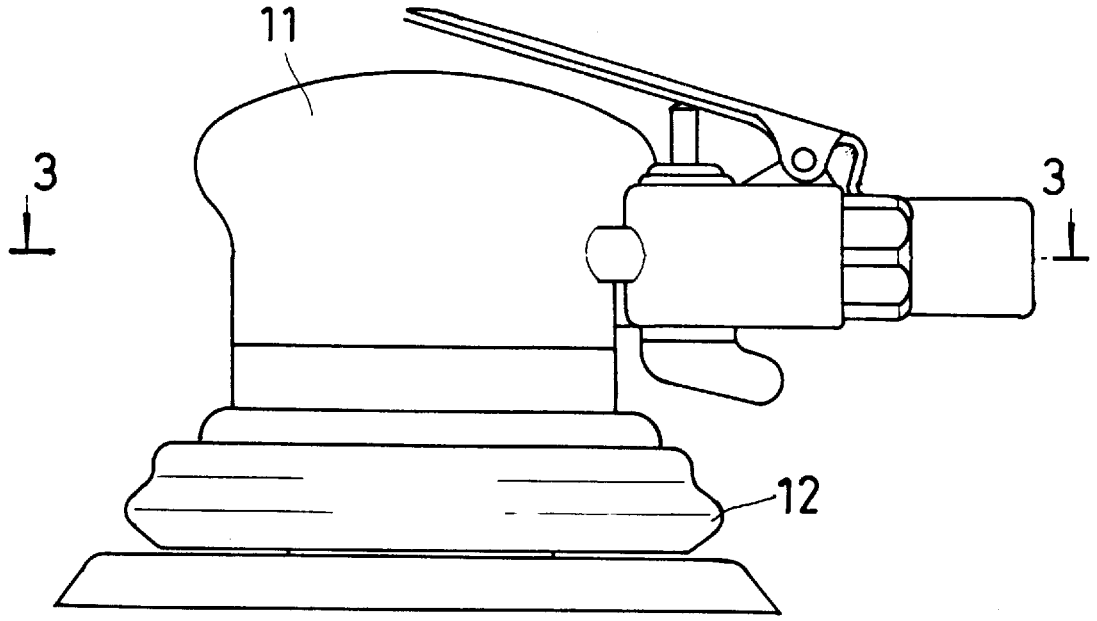
PRIOR ART FIG. 1
FIG. 1 shows a conventional pneumatic grinding/polishing machine.
Figure 2:
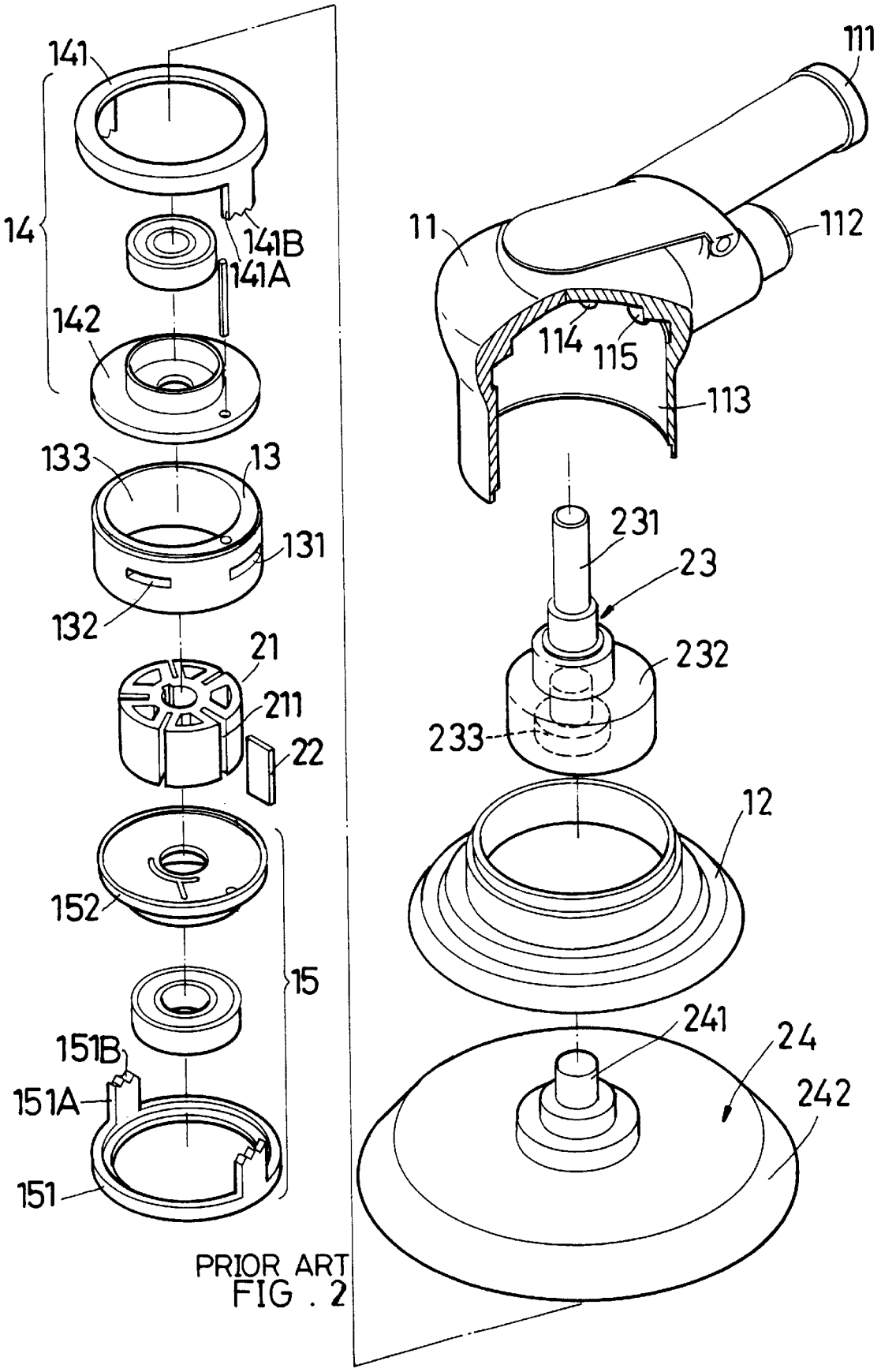
PRIOR ART FIG. 2
FIG. 2 is a perspective exploded view of the conventional pneumatic grinding/polishing machine.
Figure 3:
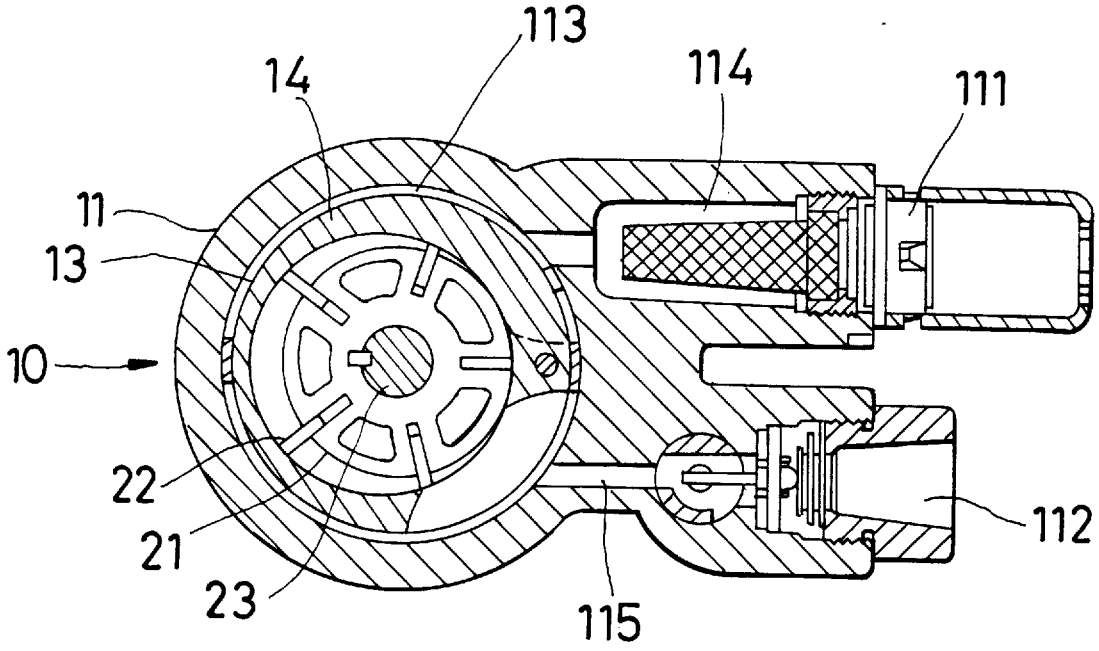
PRIOR ART FIG. 3
FIG. 3 is a sectional assembled view of the conventional pneumatic grinding/polishing machine.
Figure 4A:
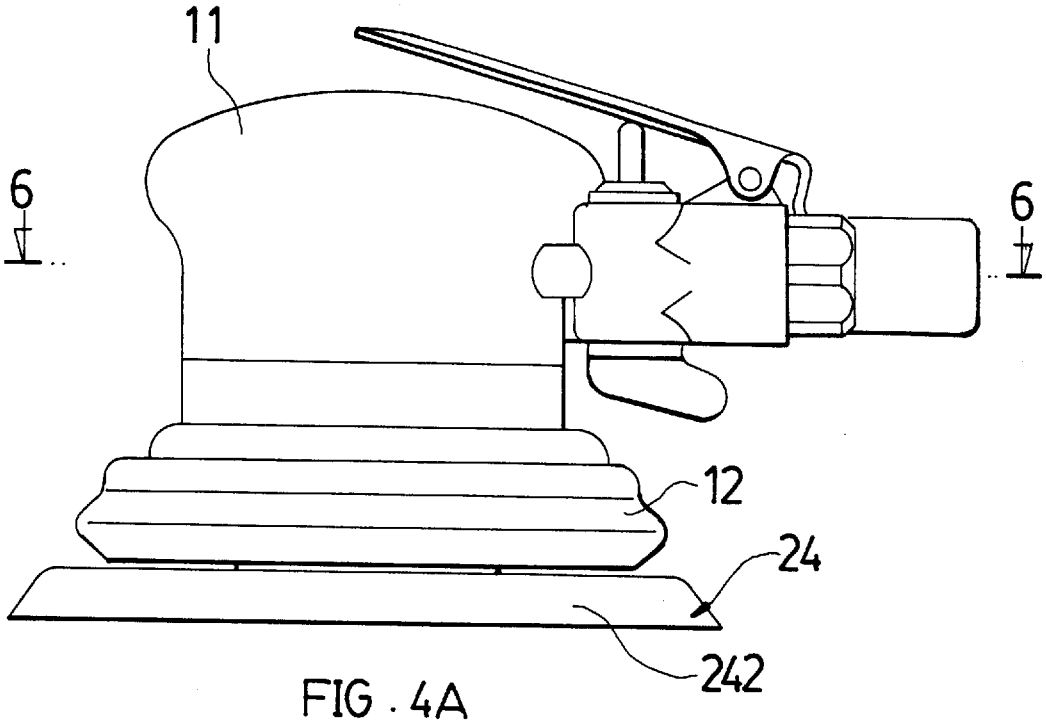
FIGS. 4A and 4B show the present invention.
Figure 4B:
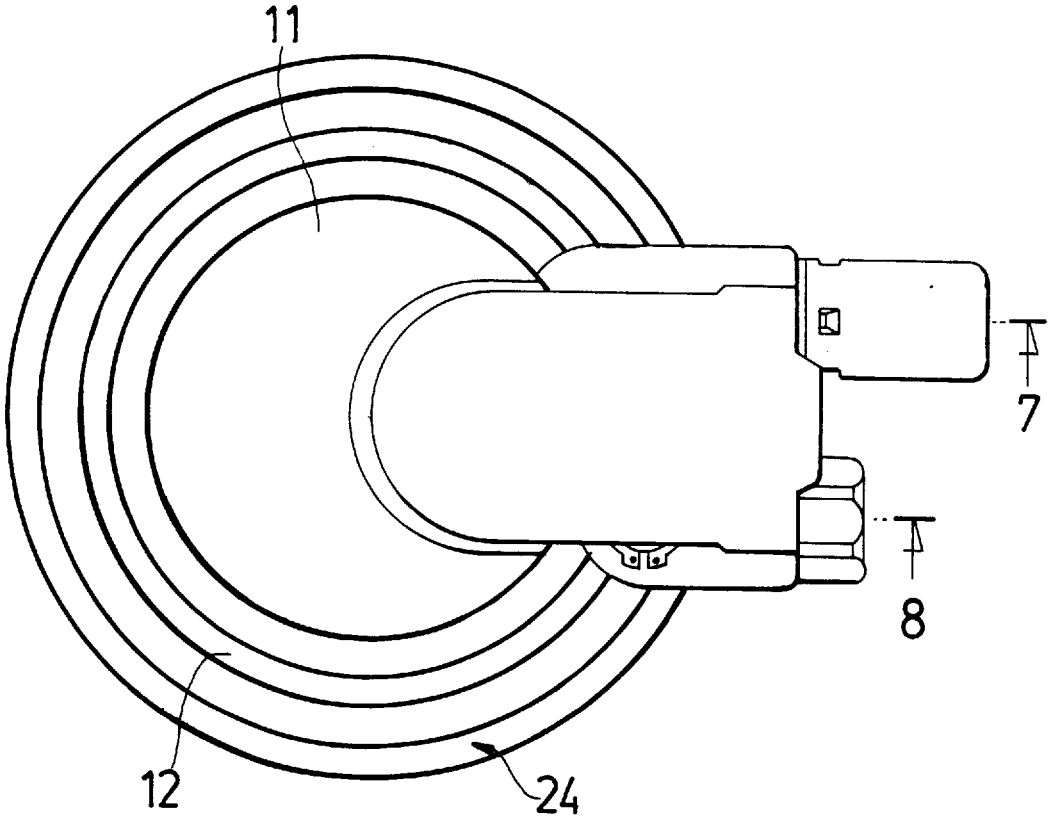

Please refer to FIGS. 4A, 4B to 7. The pneumatic grinding/polishing machine of the present invention includes:

an upper casing 11 having an air inlet 111 connected to an external high pressure air source, an air outlet 112 communicated with ambient air, a central chamber 113, an inlet passage 114 communicating the air inlet 111 and the central chamber 113 and an outlet passage 115 communicating the air outlet 112 and the central chamber 113;

a lower casing 12 secured to the bottom edge of the upper casing 11;

an annular wall 13 disposed in the central chamber 113 and having an inlet port 131 corresponding to the inlet passage 114, an outlet port 132 corresponding to the outlet passage 115 and a rotor receptacle 133;

an upper sealing member 4;

a lower sealing member 5;

a rotor 21 having multiple vane slots 211, a top end and a bottom end of the rotor 21 being surrounded by the upper and lower sealing members 4, 5;

multiple vanes 22 respectively received in the vane slots 211, whereby the space between the rotor 21 and the annular wall 13 is divided into several small rooms;

a central shaft assembly 23 having a central shaft 231, an eccentric block 232 positioned at the bottom end of the central shaft 231 and an eccentric recessed seat 233; and a grinding tray assembly 24 having a grinding tray shaft 241 and a grinding tray 242.

The rotor 21 is rotatably disposed on the upper and lower sealing members 4, 5 via a first and a second bearings 25, 26. The grinding tray assembly 24 is rotatably disposed in the eccentric recessed seat 233 of the central shaft assembly 23 via a third bearing 27.

The inlet port 131 of the annular wall 13 is disposed above the outlet port 132 and the inlet port 131 and the outlet port 132 are isolated from each other by a middle stopper ring 6.

The upper sealing member 4 has an upper stopper ring 41 and an upper cover body 42.

Figures 5A, 5B:
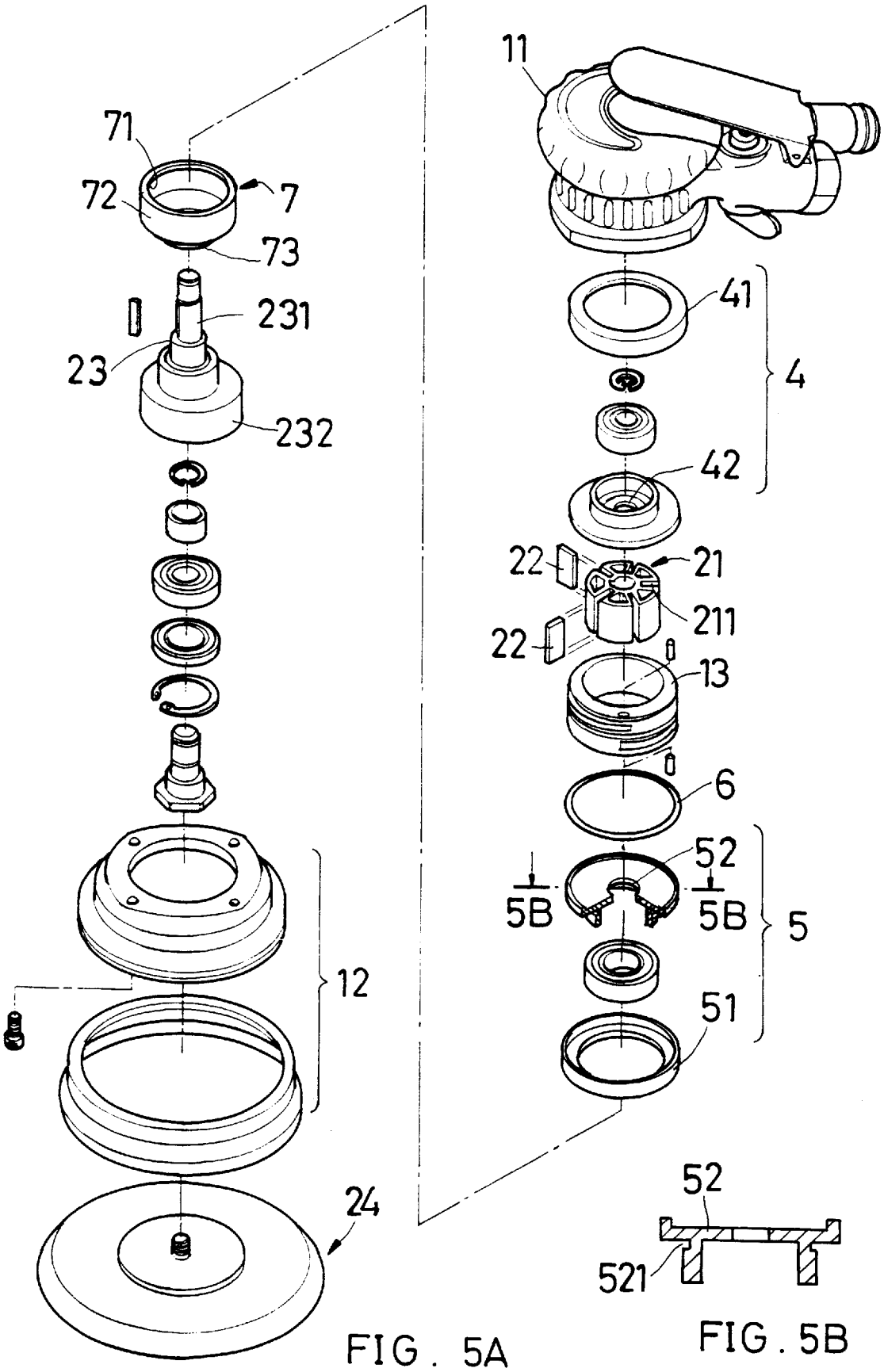
FIG. 5A is a perspective exploded view of the present invention.
FIG. 5B is a partially sectional view of the lower cover body of the present invention.
Figure 6:
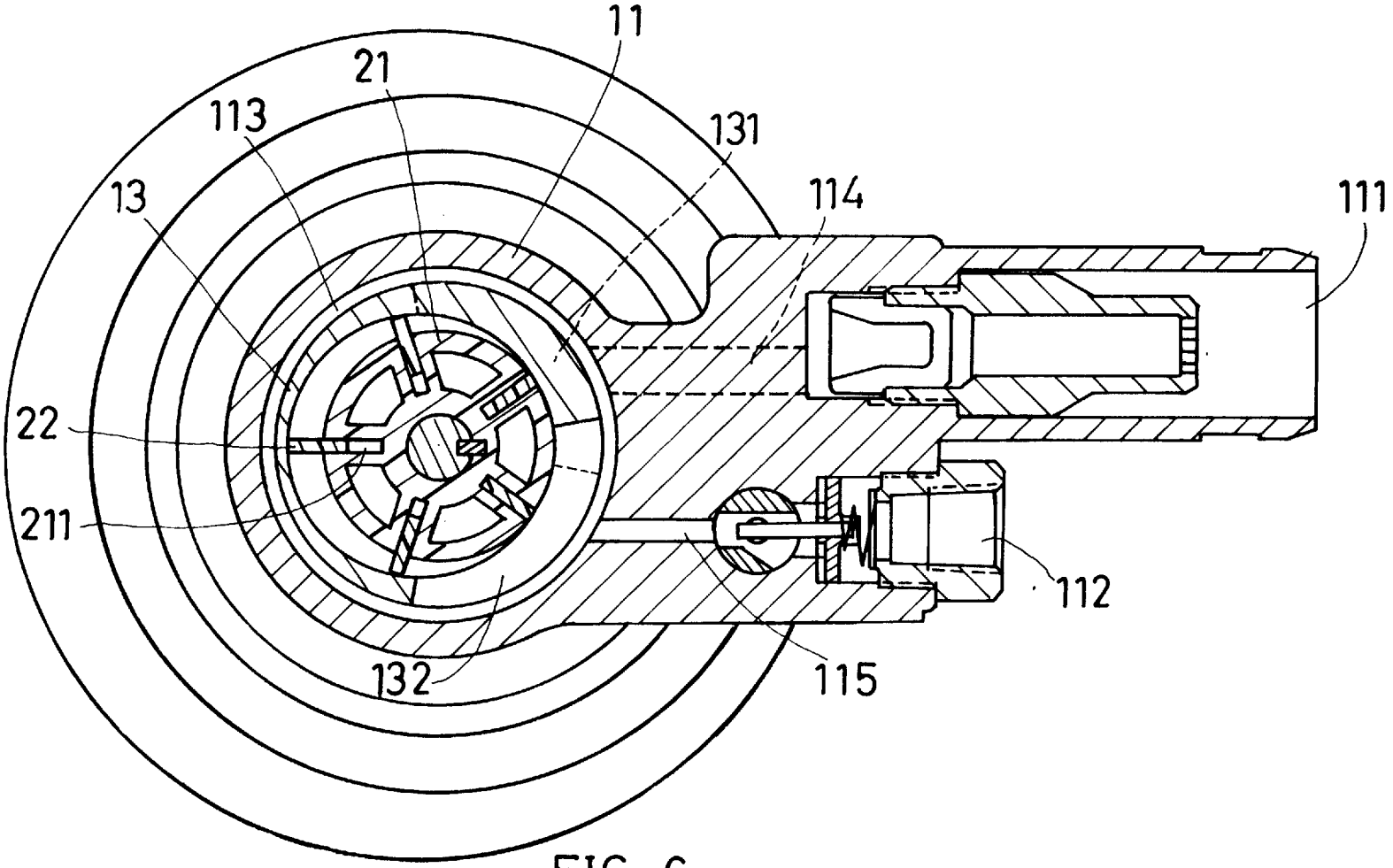
FIG. 6 is a sectional assembled view of the present invention.
Figure 7:
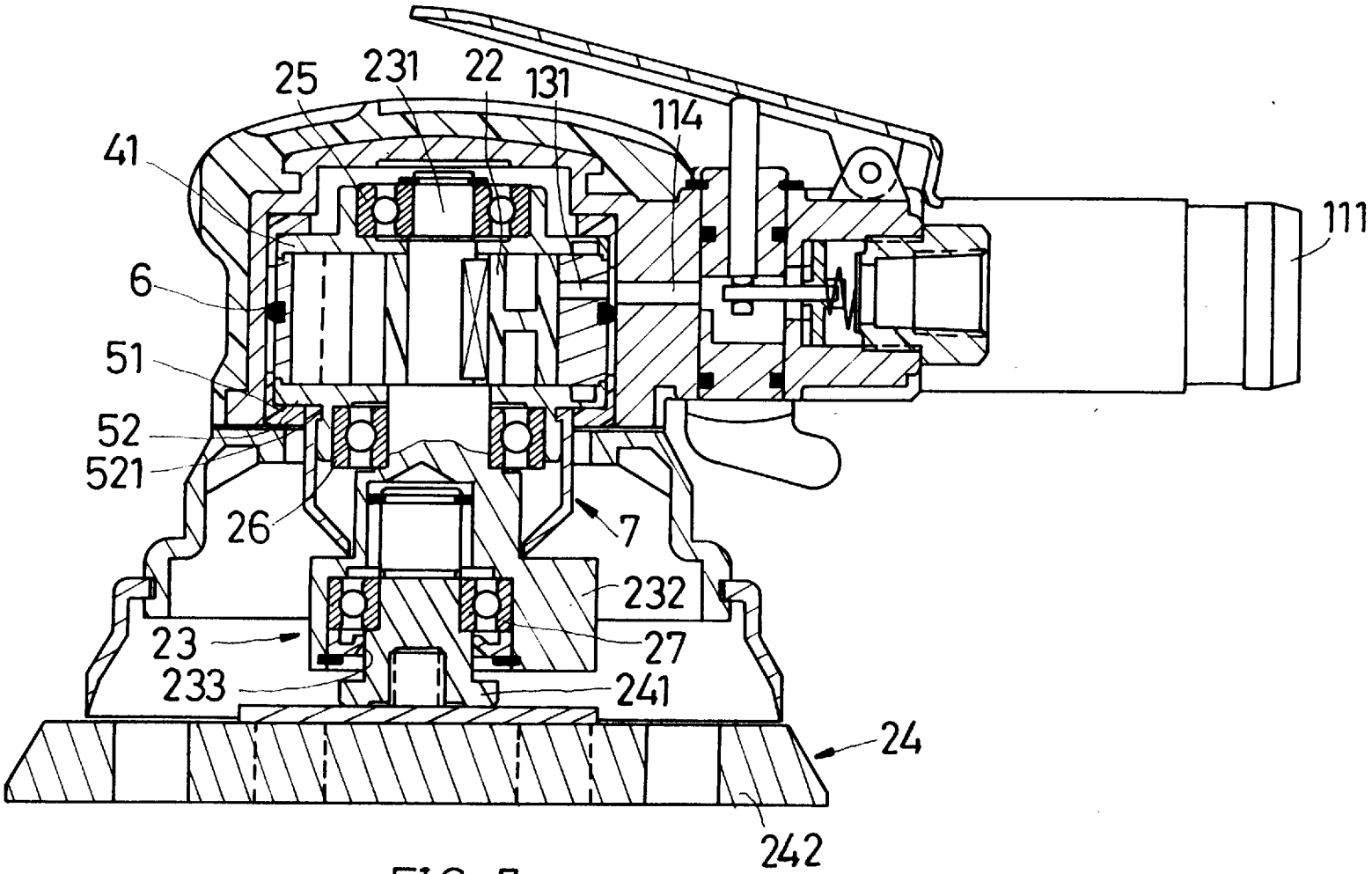
FIG. 7 is a sectional assembled view of the air inlet portion of the present invention.
Figure 8:
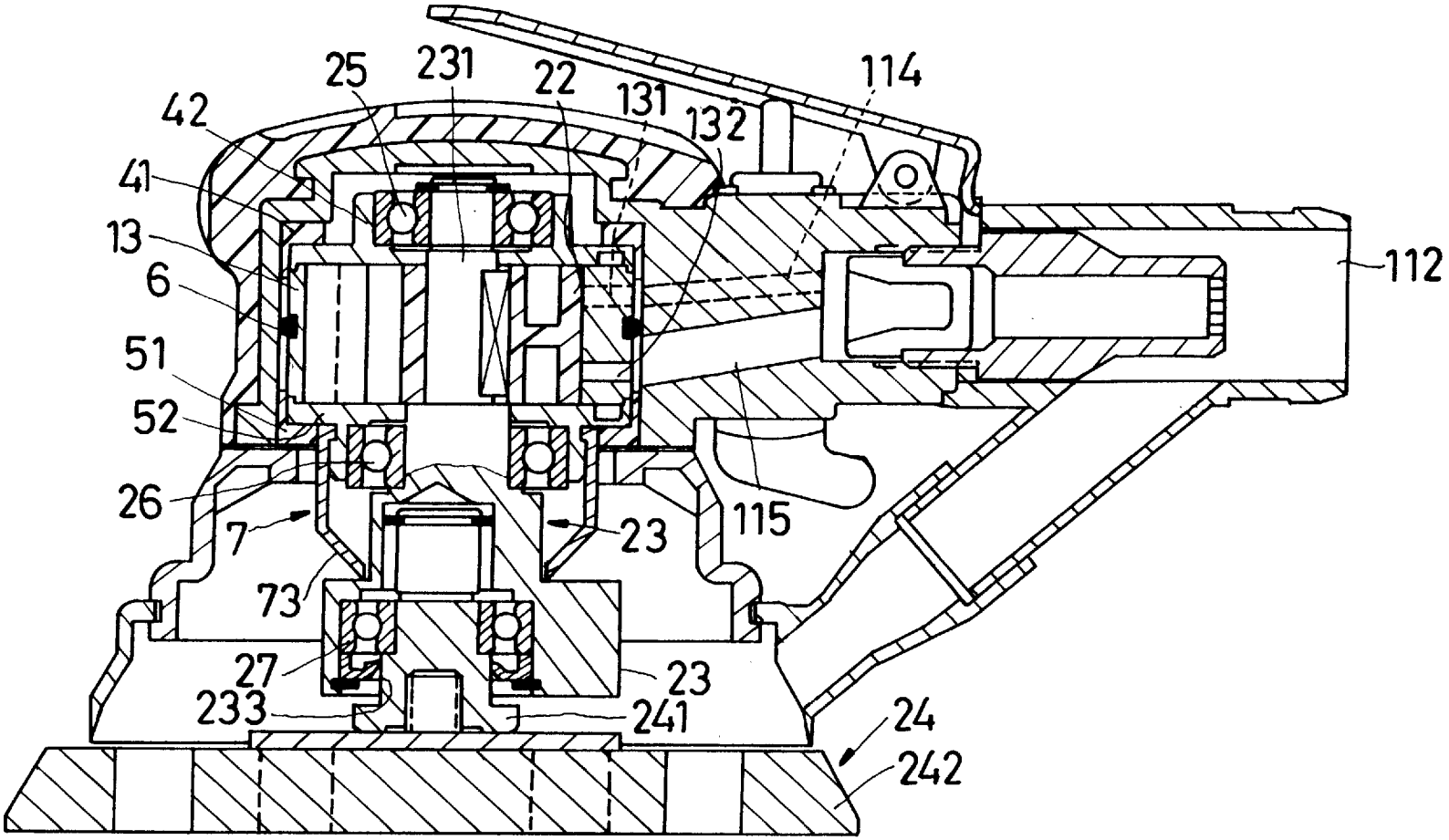
FIG. 8 is a sectional assembled view of the air outlet portion of the present invention.

The lower sealing member 5 has a lower stopper ring 51 and a lower cover body 52. As shown in FIG. 5B, the lower cover body 52 has an engaging annular groove 521.

A dustproof sheath 7 is disposed around the second bearing 26 for preventing the splashing dust from contacting with the second bearing 26. The dustproof sheath 7 includes:

an engaging flange 71 engaged in the engaging annular groove 521 of the lower cover body 52 so as to fix the dustproof sheath 7 in the lower sealing member 5;

a cylindrical section 72; and a conic section 73 having an opening at the end, through which the central shaft 231 is sealedly passed, whereby the dust is prevented from entering the second bearing 26.

In actual operation, after high pressure air is guided into the air inlet 111, the air goes into the inlet port 131 for pushing the vanes 22 so as to rotate the rotor 21. The air is finally exhausted from the air outlet 112 through the outlet port 132. The rotor 21 will drive the central shaft assembly 23 to rotate for driving the eccentric grinding tray 242 to irregularly rotate so as to grind the surface of the work piece.

According to the above arrangement, the upper, middle and lower stopper rings 41, 6 and 51 serve to fix the annular wall 13. In addition, the middle stopper ring 6 serves to effectively isolate the inlet port 131 from the outlet port 132 with an excellent leakproof effect. Also, the dustproof sheath 7 prevents the splashing dust from entering the second bearing 26 so as to prolong the using life of the grinding/polishing machine.

It is to be understood that the above description and drawings are only used for illustrating one embodiment of the present invention, not intended to limit the scope thereof. Any variation and derivation from the above description and drawings should be included in the scope of the present invention.

What is claimed is:

1. A pneumatic grinding/polishing machine comprising:

an upper casing having an air inlet connected to an external high pressure air source, an air outlet communicated with ambient air, a central chamber, an inlet passage communicating the air inlet and the central chamber and an outlet passage communicating the air outlet and the central chamber;

a lower casing secured to the bottom edge of the upper casing;

an annular wall disposed in the central chamber and having an inlet port corresponding to the inlet passage, an outlet port corresponding to the outlet passage and a rotor receptacle;

an upper sealing member;

a lower sealing member;

a rotor having multiple vane slots, a top end and a bottom end of the rotor being surrounded by the upper and lower sealing members;

multiple vanes respectively received in the vane slots, whereby a space between the rotor and the annular wall is divided into several small rooms;

a central shaft assembly having a central shaft, an eccentric block positioned at the bottom end of the central shaft and an eccentric recessed seat; and a grinding tray assembly having a grinding tray shaft and a grinding tray, the rotor being rotatably disposed on the upper and lower sealing members via a first and a second bearings, the grinding tray assembly being rotatably disposed in the eccentric recessed seat of the central shaft assembly via a third bearing;

wherein:

the inlet port of the annular wall is disposed above the outlet port and the inlet port and the outlet port are isolated from each other by a middle stopper ring, the upper sealing member having an upper stopper ring and an upper cover body, the lower sealing member having a lower stopper ring and a lower cover body, a dustproof sheath being disposed around the second bearing for preventing splashing dust from contacting with the second bearing.

2. A grinding/polishing machine as claimed in claim 1, wherein the dustproof sheath comprising:

an engaging flange for fixing the dustproof sheath in the lower sealing member;

a cylindrical section; and a conic section having an opening at an end, through which the central shaft is sealedly passed, whereby dust is prevented from entering the second bearing.

* * * * *